United States Patent [19]

Mutschler

[11] Patent Number: 4,728,214

[45] Date of Patent: Mar. 1, 1988

[54] INK DUCT FOR TUBULAR STYLUSES

[76] Inventor: Otto Mutschler,
Ludolf-Krehl-Strasse 21, D-6900
Heidelberg, Fed. Rep. of Germany

[21] Appl. No.: 810,013

[22] Filed: Dec. 17, 1985

[30] Foreign Application Priority Data

Dec. 17, 1984 [DE] Fed. Rep. of Germany ..... 3445944

[51] Int. Cl.[4] ..... B43K 1/06; B43K 1/10; B43K 8/00

[52] U.S. Cl. ..... 401/258; 401/260

[58] Field of Search ..... 401/258, 259, 260, 227, 401/225

[56] References Cited

U.S. PATENT DOCUMENTS

| | | | |
|---|---|---|---|
| 1,425,150 | 8/1922 | Ullrich | 401/259 |
| 2,681,041 | 6/1954 | Zodtner et al. | 401/227 X |
| 2,770,221 | 11/1956 | Tonkowich | 401/227 |
| 3,521,969 | 7/1970 | Mutschler | 401/225 |
| 3,836,266 | 9/1974 | Lorenz et al. | 401/259 |
| 3,938,899 | 2/1976 | Mutschler | 401/260 |
| 4,160,256 | 7/1979 | Dziuk | 401/260 X |
| 4,390,299 | 6/1983 | Mutschler | 401/259 X |
| 4,461,591 | 7/1984 | Mutschler | 401/258 |
| 4,522,525 | 6/1985 | Saito et al. | 401/259 X |
| 4,556,336 | 12/1985 | Sano et al. | 401/227 X |

FOREIGN PATENT DOCUMENTS

| | | |
|---|---|---|
| 7633429 | 10/1976 | Fed. Rep. of Germany . |
| 3205800 | 10/1982 | Fed. Rep. of Germany . |
| 3338277 | 11/1985 | Fed. Rep. of Germany . |

*Primary Examiner*—Steven A. Bratlie
*Attorney, Agent, or Firm*—Toren, McGeady & Associates

[57] ABSTRACT

The invention relates to an ink duct for tubular styluses on writing implements with a compensating system and with an air access and escape system and consists substantially of a connecting system between writing tube and ink storage tank comprising capillary gaps, grooves and plane gaps, which ensures a regulated ink flow and a pressure compensation between the storage tank internal pressure and the ambient air pressure. Consequently, even a tubular stylus with a large charge volume, in the case of a non-refillable writing implement for example, is controlled reliably by this system in the case of pressure differences and with the required vibration resistance.

3 Claims, 10 Drawing Figures

INK DUCT FOR TUBULAR STYLUSES

BACKGROUND OF THE INVENTION

1. Field of the Invention

The invention relates to an ink duct for tubular styluses.

2. Description of the Prior Art

It is customary, for tubular styluses, to employ spiral compensating systems, which have the disadvantage that in the case of an ink storage volume in excess of 1.5 $cm^3$ the spiral system reacts too sluggishly to temperature fluctuations and undesirable drop formation occurs at the tip of the writing tube.

German Offenlegungsschrift No. 3,205,800 discloses an ink duct system for ink drawing implements with a spiral, labyrinthine ink compensation means, or provided with longitudinal chambers, with axially movable drop weight with cleaning wire and writing tube, in which the ink compensation means has in its internal bore, or the drop weight on its envelope surface, at least one capillary groove multiply subdivided in the longitudinal direction, which extends as a relatively low-capillary ventilation capillary from the connecting tube to a narrower air control point located in the lower half of the ink compensating means and is passed below ink control point as a high-capillary connecting capillary to the writing-tube, whilst an axially oriented ink capillary is in communication with the air control point. The ink duct system has no lamellae, but a spiral system.

The documents of German Utility Design No. 7, 633,429 relates to a writing tip for tubular writing implements with drop weight and securing element, in which an optionally spring-like connecting element, which is provided between drop weight and securing element, is constructed integrally with, or otherwise firmly connected to, both the parts.

The aim of the invention is to propose an ink duct system which reliably controls a volme of ink in excess of approximately 1.5 $cm^3$, such as is demanded for a non-refillable drawing implement for example, and therefore reacts more sensitively to temperature fluctuations and nevertheless embodies the advantage of vibration resistance in the spiral system.

SUMMARY OF THE INVENTION

The mode of achieving this aim is disclosed by the technical teaching described in the characterized clause of patent claim 1.

Other advantageous further developments are set forth in the subordinate claims.

A similar system is known from German Offenlegungsschrift No. 3,338,227, where a compensating element with lamellae is employed, in which air access to and escape from the lamellar system is effected by two air grooves arranged parallel to the central air groove.

This is achieved by prolonging the plug-on sleeve with a head piece, that is to say a tubular element on which a lamellar system is integrally shaped, which is maintained on a plug-on stud by frictional engagement. This plastic lamellar element serves with its bore to house the writing tube. The bore is widened to the rear and the wire housing is mounted movably therein. It is of the utmost importance for the function of this system that the capillary ink supply system which supplies inks to the annular gap in the writing tube does not exhibit widened parts in any region, because the supply of ink to the annular gap in the writing tube would be threatened thereby.

In the region of the perforation which connects the capillary gap to the bore, due to the movable mounting of the wire housing it must be ensured that the ink flow does not break off at this point. Where a drop weight is employed there is the danger that when the implement is held obliquely, in the writing position for example, the wire housing closes the bottom perforation and the ink flow thereby breaks off. In order to prevent this, it is advantageous to shape longitudinal fins of small-width integrally in the bore, which guide the wire housing closely and prevent the perforation from being closed.

In order to secure also the transfer of the ink into the plane gap, it is advantageous here again to limit the movement of the wire housing by integrally shaped cams which are located on the annular plane surface.

In order to secure the connection from the plane gap to the annular gap in the writing tube, it is further advantageous to make the rear end of the writing tube extend as far as the plane gap. The integrally shaped cone on the writing tube, the cone of the wire housing and the regulating wire thus secure the regular flow of ink to the tip of the writing tube.

It may be necessary from considerations of cost to omit the drop weight and to provide only a spring which is advantageously shaped integrally on the wire housing made of plastic, and retains the regulating wire in the correct functional position.

BRIEF DESCRIPTION OF THE DRAWINGS

FIGS. I–IV and Va–f illustrate embodiments of the invention.

DETAILED DESCRIPTION OF THE INVENTION

Figure 1:
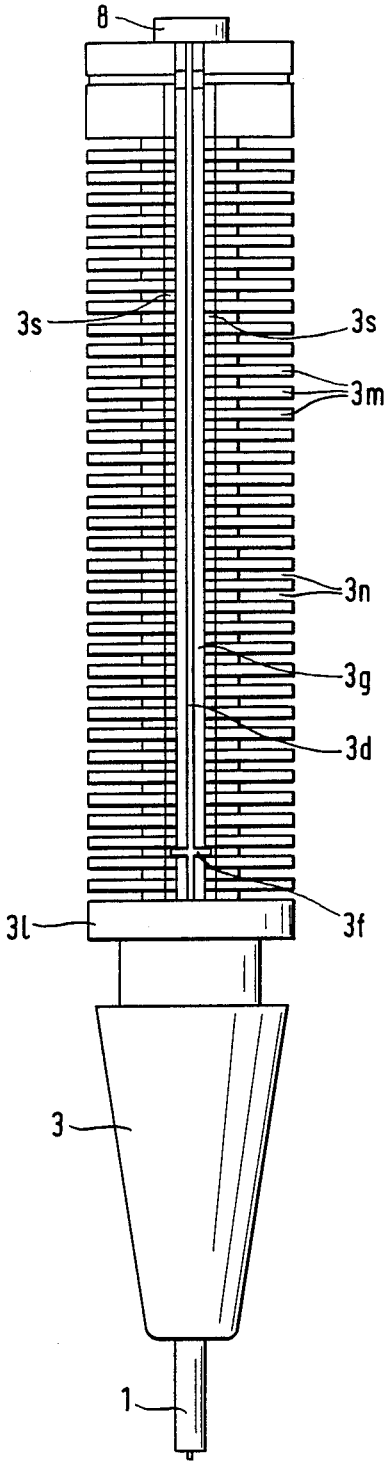
Figure 2:
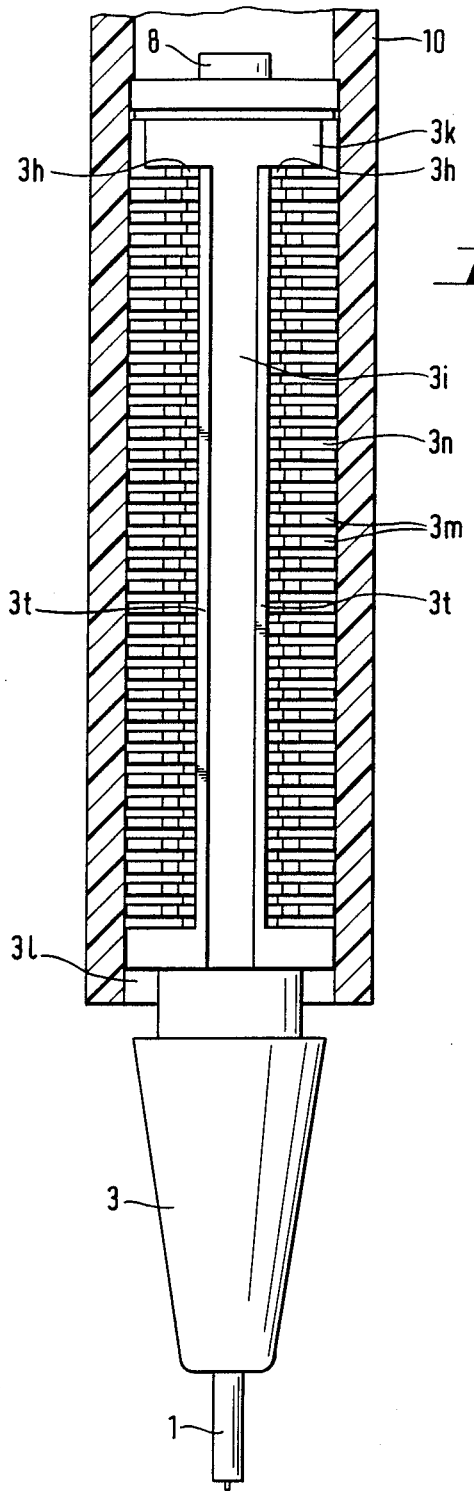
Figure 3:
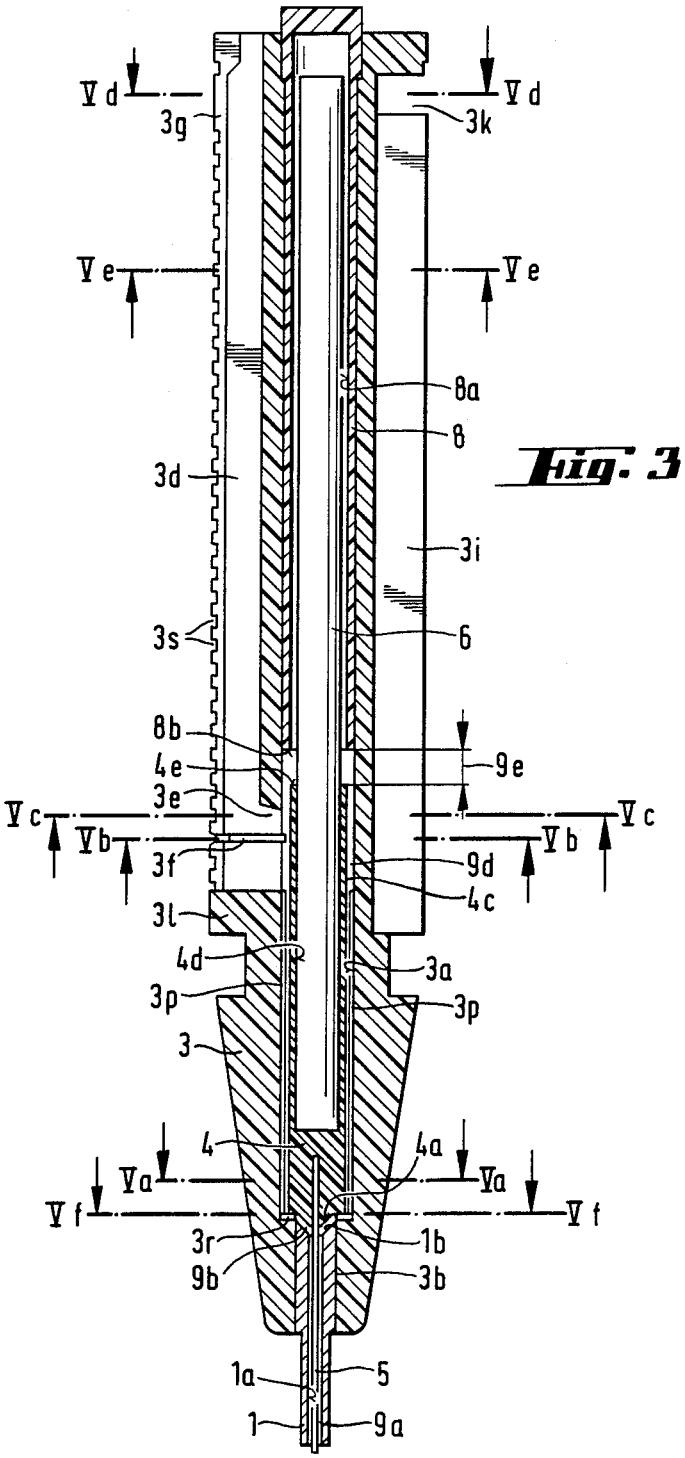
Figure 4:
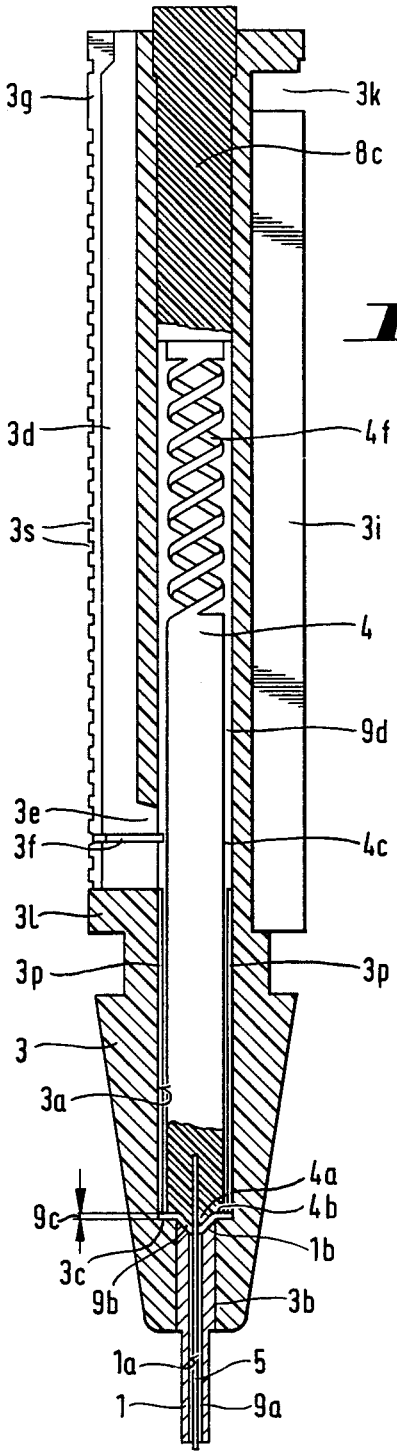
Figure 5A:
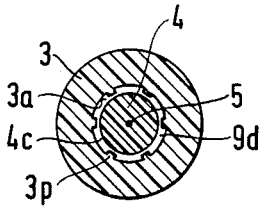
Figure 5D:
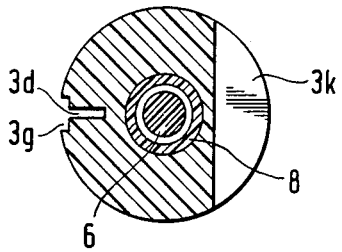
Figure 5B:
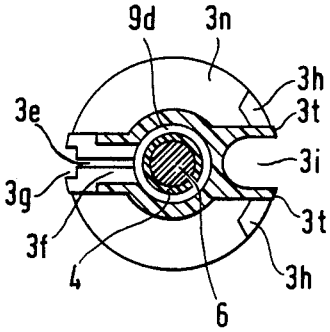
Figure 5E:
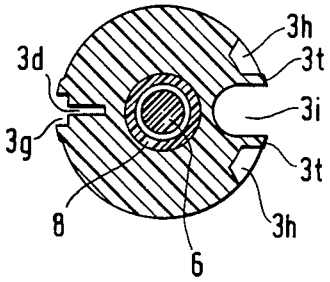
Figure 5C:
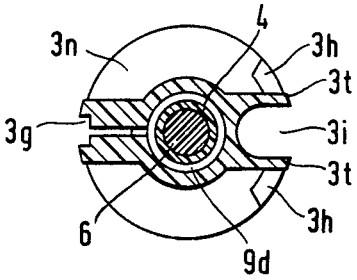
Figure 5F:
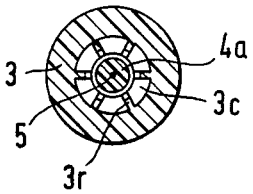

FIG. I shows a plastic lamellar element 3 with a flange 3*l*, an annular gap 3*f*, an air groove 3*g*, a capillary gap 3*d*, chambers 3*n*, lamellae 3*m*, capillary grooves 3*s*, a plug 8 and a writing tube 1.

FIG. II shows a writing tube 1, the plastic lamellar element 3, the flange 3*l*, the lamellae 3*m*, the chambers 3*n*, an air groove 3*i*, ventilation grooves 3*h*, a transverse groove 3*k*, the plug 8 and a part of a storage tank 10. Webs are designated 3*t*.

FIG. III shows a longitudinal section through the writing element. Visible are the writing tube 1 and its bore 1*a*, an annular gap 9*a* in the writing tube 1, a regulating wire 5, a conical bore 1*b* in the writing tube 1, a bore 3*b* in the plastic lamellar element 3, an annular gap 9*b* between conical bore 1*b* and cam 3*r*, a wire housing 4, the plastic lamellar element 3, a bore 3*a* in the plastic lamellar element 3, an annular gap 9*d*, longitudinal fins 3*p*, a bore 4*d* in the wire housing 4, an external diameter 4*c* of the wire housing 4, the stroke path 9*e* of the wire housing 4, the rear end 4*e* of the wire housing 4, the capillary grooves 3*s*, a drop weight 6, the capillary gap 3*d*, the air groove 3*i*, the plug 8 with a bore 8*a* and with an annular plane surface 8*b*, the transverse groove 3*k* and the air groove 3*g*. The capillary perforation is designated 3*e*, whereas 3*f* represents the regulating gap. FIG. III also shows the section positions of the cross-sections a—a, b—b, c—c, d—d, e—e, f—f.

FIG. IV likewise shows a longitudinal section through the writing element. In this drawing the wire housing 4 may be seen with an integrally shaped plastic spring 4*f*. A cone on the wire housing 4 is designated 4*a*, whilst 8*c* identifies the plug for a construction with spring 4*f* for the wire housing 4. The reference numeral 4*b* designates an annular plane surface of the wire housing 4, and 9*c* a plane gap between 3*c* and 4*b*. 3*c* is an annular plane surface. All the remaining reference numerals correspond to FIG. III.

FIG. Va shows the cross-section a—a according to FIG. III, in which the external diameter 4*c* of the wire housing 4, the bore 3*a* in the plastic lamellar element 3, the longitudinal fins 3*p* and the annular gap 9*d* are visible.

FIG. Vb shows the cross-section b—b according to FIG. III, in which the drop weight 6, the wire housing 4, the chambers 3*n*, the air grooves 3*i* and 3*g* and the ventilation grooves 3*h*, the regulating gap 3*f* and the perforation 3*e* are visible. 9*d* is the annular gap and 3*t* are the webs.

FIG. Vc illustrates the cross-section c—c, in which the drop weight 6, the wire housing 4, the chambers 3*n*, the air grooves 3*i* and 3*g* and the ventilation grooves 3*h*, and also the webs 3*t* are visible.

FIG. Vd shows the cross-section d—d, in which the transverse groove 3*k*, the plug 8, the capillary gap 3*d* and the air groove 3*g* are visible.

FIG. Ve shows the cross-section e—e, in which the drop weight 6, the plug 8, the air grooves 3*i* and 3*g*, the capillary gap 3*d* and the ventilation grooves 3*h* are visible, and lastly FIG. Vf shows the cross-section f—f according to FIG. III, in which the cone 4*a* of the wire housing 4, the annular plane surface 3*c* with the cams 3*r* shaped integrally on this plane surface are visible.

The function of the ink duct according to the invention is as follows:

The ink flows from the storage tank 10 into the capillary gap 3*d*, into the perforation 3*e*, fills the regulating gap 3*f* and the capillary grooves 3*s*, flows via the annular gap 9*d*, the plane gap 9*c*, the annular gap 9*b* in the cone and the annular gap 9*a* to the tip of the writing tube. Lastly, the air groove 3*g* also becomes partially filled with ink. When ink is consumed during writing or drawing, a negative pressure occurs in the storage tank 10, which negative pressure draws the ink out of the air grooves 3*g* and the regulating gap 3*f* and allows the air which is present in the air groove 3*i* and 3*h* to flow into the storage tank 10 until pressure equalization occurs from the storage tank internal pressure to the ambient air pressure. When pressure equalization has been achieved, the ink in the regulating gap 3*f* closes the air access to the storage tank 10. When the air volume in the storage tank 10 is increased by heating or by pressure difference, the ink flows, the regulating gap 3*f* being closed, via the capillary grooves 3*s* into the chambers 3*n* which are reduced in cross-section to-wards the rear, and the ventilation grooves 3*h*, until the pressure between storage tank 10 and ambient air has been equalized, without drop formation occurring on the tube tip. If ink is consumed by writing in this state, then the ink is first sucked out of the chambers 3*n* via capillary grooves 3*s*. Only when the latter have been exhausted does the regulating gap 3*f* open the passage for the air and allow the latter to enter the storage tank 10 via the air groove 3*g*. Consequently even a tubular stylus with a large charge volume, in the case of a non-refillable writing implement for example, is controlled reliably by this system in the case of pressure differences and with the required vibration resistance.

I claim:

1. Ink duct for tubular styluses in writing implements comprising a plastic element with a compensating system of lamellar construction, with grooves (3*h*, 3*i*) separated by webs (3*t*) for the access and escape of air with collecting chamber halves arranged on a tubular element (3) which have air access grooves and air escape grooves (3*h*) separated fluidtightly by two parallel webs (3*t*) to the central air groove (3*i*), which are closed in front by a flange (3*l*) and connected at the rear via a transverse groove (3*k*) to the central air groove (3*i*), the improvement comprising that an annular gap (9*a*) which is provided in the writing tube (1) between a wire and the interior wall of the writing tube (1), merges in an annular gap (9*b*) between a conical bore of the writing tube (1) and a cone (4*a*) of a wire housing (4) and a plane gap (9*c*) between an annular plane surface (3*c*) of the plastic lamellar element (3) and an annular plane surface (4*b*) of the wire housing (4), whilst the plane gap (9*c*) is adjoined by a capillary annular gap (9*d*) between the external surface (4*c*) of the wire housing (4) and the bore (3*a*) of the plastic lamellar element (3), which exhibits a lateral perforation (3*e*) which penetrates the plastic lamellar element (3) in the front lamellar region as far as the bore (3*a*) and is connected via a capillary gap (3*d*) in the lamellar region of the plastic lamellar element (3) to a storage tank, that longitudinal fins (3*p*) shaped integrally on the plastic lamellar element (3), which extend to the perforation (3*e*) and to the narrow guidance of the wire housing (4) are provided, that cams (3*r*) are shaped integrally on the annular plane surface (3*c*), on which the annular plane surface (4*b*) of the wire housing (4) is constructed to limit the stroke (9*e*) of the wire housing (4) forwards and to form the plane gap (9*c*), that a plug (8) is provided, the front annular plane surface (8*b*) of which can be brought into contact with the rear end (4*e*)of the wire housing (4) to limit the stroke (9*e*) to the rear, that the writing tube (1) extends with its rear end to the plane gap (9*c*) and that the wire (5) is guided in the writing tube (1) in its total length.

2. Ink duct according to claim 1, wherein a drop weight (6) is provided in the wire housing (4) and the drop weight (6) is supplemented by a spring (4*f*).

3. Ink duct according to claim 1 or 2, wherein the chambers (3*n*) are stepped backwards and have a cross-section which becomes smaller towards the rear.

* * * * *